US006017203A

United States Patent [19]

Sugawa et al.

[11] Patent Number: 6,017,203

[45] **Date of Patent: *Jan. 25, 2000**

[54] SCROLL COMPRESSOR HAVING SEPARATION PLATE BETWEEN HIGH AND LOW PRESSURES

[75] Inventors: Masaaki Sugawa; Nobukazu Kosone; Tetsuzou Matsugi; Kiyoharu Ikeda; Shoichiro Hara; Norihiko Toyoda, all of Tokyo, Japan

[73] Assignee: Mitsubishi Denki Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/684,575

[22] Filed: Jul. 19, 1996

[30] Foreign Application Priority Data

Jul. 25, 1995 [JP] Japan ..... 7-189293

[51] Int. Cl.[7] ..... F04C 18/04

[52] U.S. Cl. ..... 418/55.1; 418/55.5; 418/57; 29/888.022

[58] Field of Search ..... 418/55.1, 55.5, 418/57; 29/888.022

[56] References Cited

U.S. PATENT DOCUMENTS

| | | | |
|---|---|---|---|
| 5,141,420 | 8/1992 | Nambiar | 418/55.1 |
| 5,240,391 | 8/1993 | Ramshankar et al. | 418/55.6 |

FOREIGN PATENT DOCUMENTS

| | | | |
|---|---|---|---|
| 62-199986 | 9/1987 | Japan . | |
| 63-80088 | 4/1988 | Japan . | |
| 4-128580 | 4/1992 | Japan | 418/57 |
| 4-241702 | 8/1992 | Japan | 418/55.1 |
| 81210181 | 3/1993 | Japan . | |
| 6-93982 | 4/1994 | Japan | 418/55.1 |
| 6-159263 | 6/1994 | Japan | 418/55.1 |
| 6-272677 | 9/1994 | Japan | 418/55.1 |
| 81109193 | 12/1994 | Japan . | |
| 2 229 226 | 9/1990 | United Kingdom . | |
| 2 291 681 | 1/1996 | United Kingdom . | |
| WO 93/21440 | 10/1993 | WIPO . | |

OTHER PUBLICATIONS

Patent Abstracts of Japan, vol. 10, No. 196 (M–497), Jul. 10, 1986, JP 61 040473, Feb. 26, 1986.

*Primary Examiner*—John J. Vrablik
*Attorney, Agent, or Firm*—Oblon, Spivak, McClelland, Maier & Neustadt, P.C.

[57] ABSTRACT

A high-performance and high-reliability scroll compressor which prevents seal property failure at seal necessary points, tooth tip contact, abnormal wear of an elastic body, fatigue failure, etc. A radially outward peripheral projection (4*c*) is formed on the full outer peripheral surface of a separation plate (4). The peripheral projection (4*c*) is set to an outer diameter reduced, relative to the inner diameter of the shell main body (9) before a shell lid (20) is sealed by welding, etc., by the dimension corresponding to the shrinkage amount of a shell main body (9). That is, before welding, a minute gap occurs between the outer peripheral surface of the peripheral projections (4*c*) and the inner peripheral surface of the shell main body (9). Then, the separation plate (4) is inserted into the shell main body (9) and further the separation plate (4) and a frame (3) are fixed. After this, when the shell main body (9) and the shell lid (20) are welded, because of shrinkage of the shell main body (9) after the welding, the outer peripheral surface of the peripheral projections (4*c*) of the separation plate (4) comes in tight contact with the inner peripheral surface of the shell main body (9), whereby the space is partitioned and sealed between a high pressure space (30) and a low pressure space (31).

12 Claims, 11 Drawing Sheets

(BEFORE WELDING)

(AFTER WELDING)

(BEFORE WELDING)

(AFTER WELDING)

(BEFORE WELDING)

(AFTER WELDING)

RELATED ART

RELATED ART

SCROLL COMPRESSOR HAVING SEPARATION PLATE BETWEEN HIGH AND LOW PRESSURES

BACKGROUND OF THE INVENTION a) Field of the Invention

This invention relates to a scroll compressor used with air conditioners, refrigerators, etc.

b) Related Art

FIG. 15 is a longitudinal sectional view of a scroll compressor disclosed in Japanese Patent Laid-Open No. Sho 62-199986 (conventional example 1).

In the figure, numeral 1 is a fixed scroll formed on one face (lower side) with a plate-like spiral tooth 1*a,* and a bed plate of the fixed scroll has an outer peripheral surface formed like a cylindrical face. A boss part 1*g* shaped like a hollow circular cylinder is protruded upward on the opposite face to the plate-like spiral tooth 1*a* (upper side of the fixed scroll 1) and a groove for housing a seal member 10*a* separating a high pressure space 30 (spout side space) and a low pressure space 31 (suction side space) is formed in a portion opposite to the outer face of the boss part 1*g*.

Numeral 2 is an orbiting scroll formed on one face (upper side) with a plate-like spiral tooth 2*a*, and a boss part 2*b* receiving a drive force from a spindle 8 is projected on the opposite side (lower side).

Numeral 3 is a frame having an outer peripheral surface stuck to the inner face of a sealed vessel 9A and an upper end part 3*a* fixed to a separation plate 4. The frame 3 supports a thrust load of the orbiting scroll 2 and supports the spindle 8 radially.

The separation plate 4 is stuck to the inner face of the sealed vessel 9A above the frame 3, thereby basically separating the space in the vessel into the high pressure space 30 and the low pressure space 31. The fixed scroll 1 is restrained in radial and rotation directions by a pin 5 pressed into the separation plate 4.

Numeral 7 is an Oldham's coupling for restraining rotation of the orbiting scroll 2 and determining a phase between the orbiting scroll 2 and the frame 3.

Numeral 8 is a spindle coupled at the top end to the lower part of the orbiting scroll 2 and torque for driving the orbiting scroll 2 is given from a motor.

Next, the operation of the scroll compressor according to the conventional example 1 will be discussed.

First, an axial force that acts on the fixed scroll 1 will be described. An upward pushing force caused by gas pressure in a compression space acts on the lower face of the fixed scroll 1. On the other hand, high pressure acts on the top face of the boss part 1*g* of the fixed scroll 1, and a force produced by the high pressure presses the fixed scroll 1 downward, namely, against the orbiting scroll 2.

Next, a radial force that acts on the fixed scroll 1 will be described. A radial outward force mainly caused by gas pressure in the compression space acts on the plate-like spiral tooth 1*a* of the fixed scroll 1. The force is transmitted via the boss part 1*g* of the base plate of the fixed scroll 1 to the separation plate 4.

Next, a moment in the rotation direction that acts on the fixed scroll 1 will be described. A moment in the rotation direction mainly caused by gas pressure in the compression space acts on the fixed scroll 1 like the orbiting scroll 2. At the orbiting scroll 2, the moment is received by the Oldham's coupling 7; at the fixed scroll 1, it is received by means of the pin 5.

On the other hand, FIG. 16 is a longitudinal sectional view of a scroll compressor disclosed in Japanese Patent Laid-Open No. Sho 63-80088 (conventional example 2).

The structure and operation of conventional example 2 will be discussed with referenced to FIG. 16.

Parts identical with or similar to those previously described with reference to FIG. 15 are denoted by the same reference numerals in FIG. 16 and will not be discussed again. Numeral 1 is a fixed scroll and four bolt screw holes are made in the outer peripheral surface of a base plate of the fixed scroll 1. Numeral 12 is an elastic body typified by a plate spring, etc., which is formed with four bolt drill holes. Bolts are inserted into the two drill holes at both ends of the elastic body 12 for fixing the elastic body 12 to the end face on the outer peripheral surface spiral side of the fixed scroll 1. Also, bolts 15 are inserted into the two drill holes at the center of the elastic body 12 for fixing the elastic body 12 to the upper end face of a frame 3. Thus, the fixed scroll 1 and the frame 3 are elastically coupled axially by the elastic body 12, but basically are fixedly coupled in a radial direction and a rotation direction around the axis. In this connection, the elastic body 12 engages the end face on the anti-spiral side of the fixed scroll 1. The fixed scroll 1 integral with the frame 3 is backed into a sealed vessel 9A and fixed and supported by press fit, arc spot welding, etc.

Means for restraining an axial upward move of the fixed scroll 1 is a member stuck to the frame 3 by the bolts 15. A separation plate 4 is not positioned with respect to the frame 3 and is welded fully to the inner peripheral surface of the sealed vessel 9A.

FIG. 17 is a partially enlarged longitudinal sectional view to show the main part of the scroll compressor of the conventional example 2.

In the figure, numeral 10*a* is a seal member separating a high pressure space 30 (spout side) and an intermediate pressure chamber 4*a* and numeral 11*a* is a seal member separating the intermediate pressure chamber 4*a* and a low pressure space 31 (suction side); they are disposed to provide a minute gap between the fixed scroll 1 and the separation plate 4. The fixed scroll 1 is formed with a communication hole 1*d* for allowing a compression space on the side of a plate-like spiral tooth 1*a* to communicate with the intermediate pressure chamber 4*a*.

In the scroll compressor of convectional example 2, as described above, the fixed scroll 1 is supported on a shell main body 9 via the frame 3. The separation plate 4 is not supported on the fixed scroll 1 and is supported on the shell main body 9. Thus, the minute gap formed between the fixed scroll 1 and the separation plate 4 via the seal members 10*a* and 11*a* leans to one side on the entire opposite face because of welding distortion or deformation caused by full peripheral surface welding of the shell main body 9 and the separation plate 4, and variations in seal property, seal failure caused by uneven contact of the separation plate 4 and the fixed scroll 1, tooth tip contact, etc., occurs, which may cause variations in compressor performance, compressor performance failure, compressor reliability degradation, or compressor destruction.

The elastic body 12 such as a plate spring used to enable the fixed scroll 1 to axially move always receives a gas load and a moment acting on the fixed scroll 1 during the operation, thus fatigue failure, abnormal wear, etc., may occur.

SUMMARY OF THE INVENTION

It is therefore an object of the invention to provide a high-performance and high-reliability scroll compressor which prevents seal property failure at seal necessary points, tooth tip contact, abnormal wear of an elastic body, fatigue failure, etc.

To the end, according to the invention, there is provided a scroll compressor which includes: a sealed vessel including a shell main body and a shell lid sealingly attached to the shell main body to close a top face of the shell main body; a fixed scroll arranged within the sealed vessel so that motion of the fixed scroll in radial and rotation directions is restrained, the fixed scroll having a plate-like spiral tooth; an orbiting scroll having a plate-like spiral tooth and forming a compression space by combining the plate-like spiral teeth of the fixed scroll and orbiting scroll; a frame fixed to an inner peripheral surface of the shell main body and slidably supporting the orbiting scroll; and a separation plate arranged in tight contact with an inner peripheral surface of the sealed vessel without welding between the separation plate and the inner peripheral surface of the sealed vessel so that a space in the sealed vessel is divided into a high pressure space and a low pressure space, wherein the frame is located within the low pressure space, and the fixed scroll is disposed below the separation plate via a moving gap permitting the fixed scroll to make a minute motion in an axial direction.

As an embodiment of the present invention, there is provided a scroll compressor comprising a shell main body, a shell lid being sealed to a top face opening of the shell main body for providing a sealed vessel together with the shell main body, a fixed scroll being placed in a state in which motion thereof in radial and rotation directions is restrained in the sealed vessel and having a plate-like spiral tooth, an orbiting scroll having a plate-like spiral tooth and forming a compression space by combining the plate-like spiral teeth of the fixed scroll and the orbiting scroll, a separation plate being disposed in tight contact with the inner peripheral surface of the sealed vessel for separating a space in the vessel into a high pressure space and a low pressure space, and a frame being fixed to the inner peripheral surface of a low pressure side of the shell main body for slidable supporting the orbiting scroll, the fixed scroll being disposed below the separation plate via a moving gap allowing the fixed scroll to make a minute motion in the axial direction, characterized in that the separation plate is set to an outer diameter having predetermined interference to such a degree that the outer peripheral surface of the separation plate pressed into the shell main body comes in tight contact with the inner peripheral surface of the shell main body.

As another embodiment of the present invention, there is provided a scroll compressor comprising a shell main body, a shell lid being sealed to a top face opening of the shell main body for providing a sealed vessel together with the shell main body, a fixed scroll being placed in a state in which motion thereof in radial and rotation directions is restrained in the sealed vessel and having a plate-like spiral tooth, an orbiting scroll having a plate-like spiral tooth and forming a compression space by combining the plate-like spiral teeth of the fixed scroll and the orbiting scroll, a separation plate being disposed in tight contact with the inner peripheral surface of the sealed vessel for separating a space in the vessel into a high pressure space and a low pressure space, and a frame being fixed to the inner peripheral surface of a low pressure side of the shell main body for slidable supporting the orbiting scroll, the fixed scroll being disposed below the separation plate via a moving gap allowing the fixed scroll to make a minute motion in the axial direction, characterized in that a radially outward peripheral projection is formed over the entire outer peripheral surface of the separation plate, of the peripheral projection is set to an outer diameter reduced, relative to an inner diameter of the shell main body before the shell lid is sealed by welding, etc. by a dimension corresponding to a shrinkage amount of the shell main body, and the outer peripheral surface of the separation plate is brought in linear contact with the inner peripheral surface of the shell main body entirely.

The axial placement position of the peripheral projection on the separation plate may be set to a position where the separation plate pressed radially inward by the shell main body shrunk after the shell lid is sealed by welding, etc., does not axially bend.

As another embodiment of the invention, there is provided a scroll compressor comprising a shell main body, a shell lid being sealed to a top face opening of the shell main body for providing a sealed vessel together with the shell main body, a fixed scroll being placed in a state in which motion thereof in radial and rotation directions is restrained in the sealed vessel and having a plate-like spiral tooth, an orbiting scroll having a plate-like spiral tooth and forming a compression space by combining the plate-like spiral teeth of the fixed scroll and the orbiting scroll, a separation plate being disposed in tight contact with the inner peripheral surface of the sealed vessel for separating a space in the vessel into a high pressure space and a low pressure space, and a frame being fixed to the inner peripheral surface of a low pressure side of the shell main body for slidable supporting the orbiting scroll, the fixed scroll being disposed below the separation plate via a moving gap allowing the fixed scroll to make a minute motion in the axial direction, characterized in that the separation plate is set to an outer diameter having predetermined interference to such a degree that the outer peripheral surface of the separation plate pressed into the shell lid comes in tight contact with the inner peripheral surface of the shell lid.

As another embodiment of the invention, there is provided a scroll compressor comprising a shell main body, a shell lid being sealed to a top face opening of the shell main body for providing a sealed vessel together with the shell main body, a fixed scroll being placed in a state in which motion thereof in radial and rotation directions is restrained in the sealed vessel and having a plate-like spiral tooth, an orbiting scroll having a plate-like spiral tooth and forming a compression space by combining the plate-like spiral teeth of the fixed scroll and the orbiting scroll, a separation plate being disposed in tight contact with the inner peripheral surface of the sealed vessel for separating a space in the vessel into a high pressure space and a low pressure space, and a frame being fixed to the inner peripheral surface of a low pressure side of the shell main body for slidable supporting the orbiting scroll, the fixed scroll being disposed below the separation plate via a moving gap allowing the fixed scroll to make a minute motion in the axial direction, characterized in that a radially outward peripheral projection is formed over the entire outer peripheral surface of the separation plate, the peripheral projection is set to an outer diameter reduced, relative to an inner diameter of the shell lid before the shell lid is sealed to the shell main body by welding, etc., by a dimension corresponding to a shrinkage amount of the shell lid, and the outer peripheral surface of the separation plate is brought in linear contact with the inner peripheral surface of the shell lid entirely.

According to the invention, there is provided a scroll compressor comprising a shell main body, a shell lid being sealed to a top face opening of the shell main body for providing a sealed vessel together with the shell main body, a fixed scroll being placed in a state in which motion thereof in radial and rotation directions is restrained in the sealed vessel and having a plate-like spiral tooth, an orbiting scroll having a plate-like spiral tooth and forming a compression space by combining the plate-like spiral teeth of the fixed scroll and the orbiting scroll, a separation plate being disposed in tight contact with the inner peripheral surface of the sealed vessel for separating a space in the vessel into a high pressure space and a low pressure space, and a frame being fixed to the inner peripheral surface of a low pressure side of the shell main body for slidable supporting the orbiting scroll, the fixed scroll being disposed below the separation plate via a moving gap allowing the fixed scroll to make a minute motion in the axial direction, characterized in that at least two radially outward flange parts are projected discontinuously in a circumferential direction on the outer peripheral surface of the fixed scroll, that an elastic body being elastically supported on a top end face of the frame for energizing the fixed scroll toward the separation plate is disposed, and that each of the flange parts is formed on a bottom face with an elastic body fixing part for fixing the elastic body and comprises a step part formed so that a portion of the flange part other than the elastic body fixing part is cut axially, the step part not interfering with the elastic body.

According to the invention, there is provided a scroll compressor comprising a shell main body, a shell lid being sealed to a top face opening of the shell main body for providing a sealed vessel together with the shell main body, a fixed scroll being placed in a state in which motion thereof in radial and rotation directions is restrained in the sealed vessel and having a plate-like spiral tooth, an orbiting scroll having a plate-like spiral tooth and forming a compression space by combining the plate-like spiral teeth of the fixed scroll and the orbiting scroll, a separation plate being disposed in tight contact with the inner peripheral surface of the sealed vessel for separating a space in the vessel into a high pressure space and a low pressure space, and a frame being fixed to the inner peripheral surface of a low pressure side of the shell main body for slidable supporting the orbiting scroll, characterized in that at least two radially outward flange parts are projected discontinuously in a circumferential direction on the outer peripheral surface of the fixed scroll and that bottom faces of the flange parts are directly supported on a top end face of the frame.

According to the invention, there is provided a scroll compressor comprising a shell main body, a shell lid being sealed to a top face opening of the shell main body for providing a sealed vessel together with the shell main body, a fixed scroll being placed in a state in which motion thereof in radial and rotation directions is restrained in the sealed vessel and having a plate-like spiral tooth, an orbiting scroll having a plate-like spiral tooth and forming a compression space by combining the plate-like spiral teeth of the fixed scroll and the orbiting scroll, a separation plate being disposed in tight contact with the inner peripheral surface of the sealed vessel for separating a space in the vessel into a high pressure space and a low pressure space, and a frame being fixed to the inner peripheral surface of a low pressure side of the shell main body for slidable supporting the orbiting scroll, the fixed scroll being disposed below the separation plate via a moving gap allowing the fixed scroll to make a minute motion in the axial direction, characterized in that at least two radially outward flange parts are projected discontinuously in a circumferential direction on the outer peripheral surface of the fixed scroll, that an elastic body being elastically supported on a top end face of the frame for energizing the fixed scroll toward the separation plate is disposed, that each of the flange parts is formed on a bottom face with an elastic body fixing part for fixing the elastic body and comprises a step part formed so that a portion of the flange part other than the elastic body fixing part is cut axially, the step part not interfering with the elastic body, and that spacers are formed like substantially the same plane form as the elastic body fixing parts and placed below the elastic body fixing parts for sandwiching the elastic body between the spacers and the elastic body fixing parts.

DETAILED DESCRIPTION OF THE PREFERRED EMBODIMENTS

Referring now to the accompanying drawings, there are shown preferred embodiments of the invention.

Figure 1:
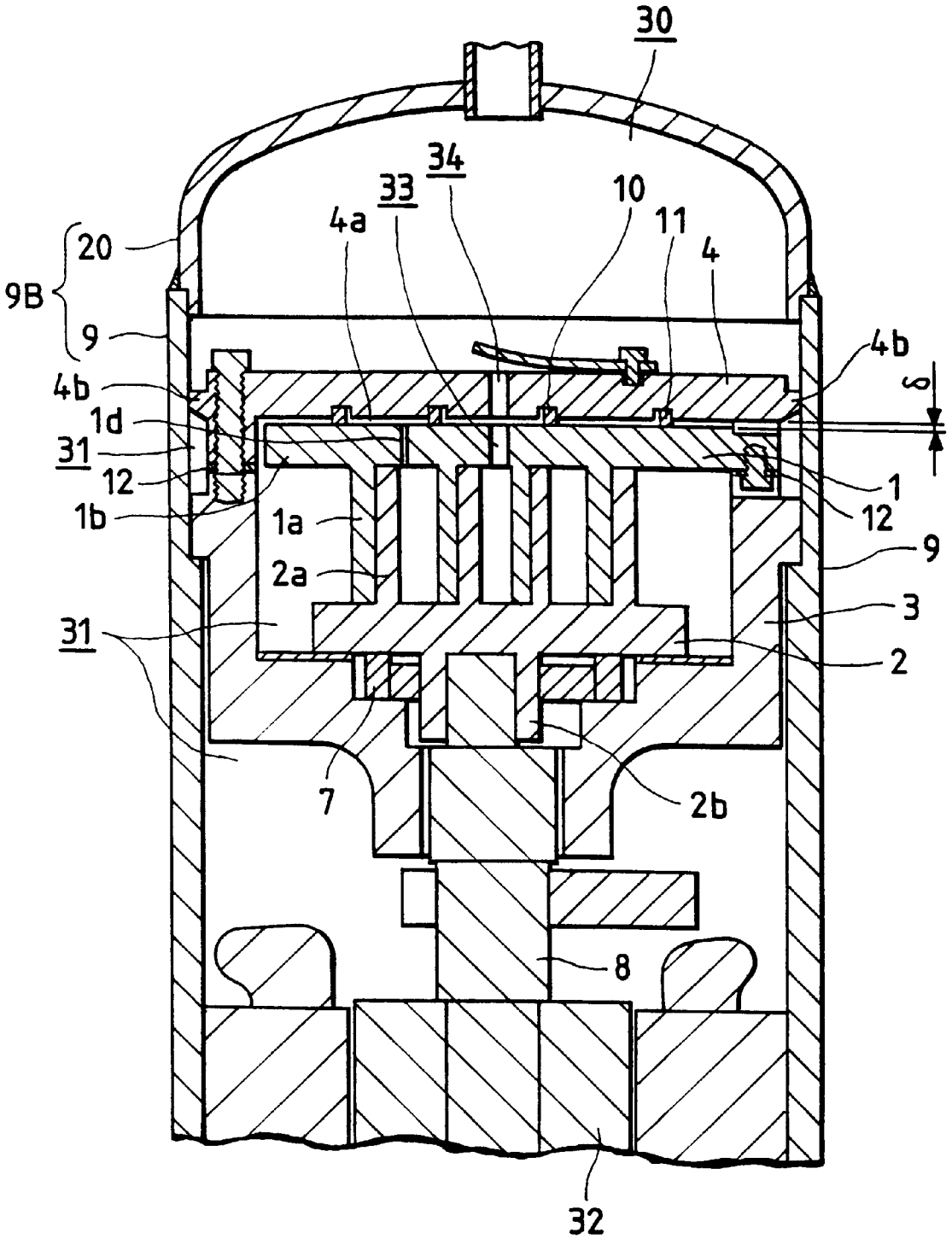
FIG. 1 is a longitudinal sectional view of the main part of a scroll compressor according to a first embodiment of the invention.

Embodiment 1:

FIG. 1 is a longitudinal sectional view of the main part of a scroll compressor according to a first embodiment of the invention.

In the figure, numeral 1 is a fixed scroll formed on one side (lower side) with a plate-like spiral tooth 1*a*. The fixed scroll 1 is placed in a sealed vessel 9B in a state in which motion of the fixed scroll 1 in radial and rotation directions is restrained. The space on the opposite side (upper side) to the plate-like spiral tooth 1*a* via a base plate 1*b* of the fixed scroll is an intermediate pressure chamber 4*a*, which is set to intermediate pressure during the operation through a communication hole 1*d* made in the fixed scroll base plate 1*b* and communicating with a compression space.

Numeral 2 is an orbiting scroll formed on one side (upper side) with an upward plate-like spiral tooth 2*a*, and a boss part 2*b* receiving a drive force from a spindle 8 is projected downward on the opposite side (lower side). The orbiting scroll 2 and the fixed scroll 1 form the compression chamber by combining their plate-like spiral teeth 1*a* and 2*a*.

Numeral 3 is a frame having an outer peripheral surface fixed to the inner face of the low pressure side of a shell main body 9 and an upper end part bolted to a separation plate 4. The frame 3 supports a thrust load of the orbiting scroll 2 and supports the spindle 8 radially.

The frame 3 and the separation plate 4 are aligned with each other in a radial direction and a rotation direction by a positioning pin such as a reamer pin.

Numeral 10 is an O-ring-like seal member made for instance of tetrafluoroethylene resin, for separating a high pressure space 30 (discharge side) and an intermediate pressure chamber 4*a* (intermediate pressure), and numeral 11 is an O-ring-like seal member made for instance of tetrafluoroethylene resin, for separating the intermediate pressure chamber 4*a* (intermediate pressure) and a low pressure space 31 (suction side).

Two grooves each being annular in a bottom view are cut in a surface of the separation plate 4 facing the fixed scroll 1, and the seal members 10 and 11 are inserted into the grooves, respectively. The seal members 10 and 11, the fixed scroll base plate 1*b*, and the separation plate 4 form the intermediate chamber 4*a*.

A predetermined moving gap δ allowing the fixed scroll 1 to make a minute motion in the axial direction is set between the fixed scroll 1 and the separation plate 4. It is set based on the dimensions of the component parts and defines the maximum relief amount of the fixed scroll 1. To even the moving gap 5, the fixed scroll base plate 1*b* and the separation plate 4 are assembled to be parallel to each other. Numeral 12 is an elastic body such as a plate spring shaped like a semi-circular arc; the elastic bodies are used in a pair.

Numeral 7 is an Oldham's coupling for restraining rotation of the orbiting scroll 2 and determining a phase between the orbiting scroll 2 and the frame 3.

Numeral 8 is a spindle, and designed so that the torque for driving the orbiting scroll 2 is given from a motor 32.

Numeral 20 is a shell lid sealingly attached to a top face opening of the shell main body 9 to form the sealed vessel 9B in corporation with the shell main body 9.

Numeral 33 is a discharge hole passing through the substantially central portion of the fixed scroll base plate 1*b*, and numeral 34 is a discharge hole passing through the substantially central portion of the separation plate 4.

On the other hand, a radially outward peripheral projection 4*b* is formed over the entire outer peripheral surface of the separation plate 4. The projection 4*b* presents a flange-like configuration. The peripheral projection 4*b* is set to an outer diameter having predetermined interference relative to the inner diameter of the shell main body 9. This predetermined interference is set to a dimension to such a degree that the outer peripheral surface of the peripheral projection 4*b* of the separation plate 4 pressed into the shell main body 9 comes in tight contact with the inner peripheral surface of the shell main body 9.

When the separation plate 4 is assembled, the separation plate 4 is pressed into the shell main body 9 and the separation plate 4, and the separation plate 4 and the frame 3 are bolted with each other under a condition that the fixed scroll 1 is held in parallel to the separation plate 4.

Therefore, the space in the sealed vessel 9B is partitioned and sealed between the high pressure space 30 and the low pressure space 31 because of the tight contact of the outer peripheral surface of the separation plate 4 and the inner peripheral surface of the shell main body 9.

Figure 2A:
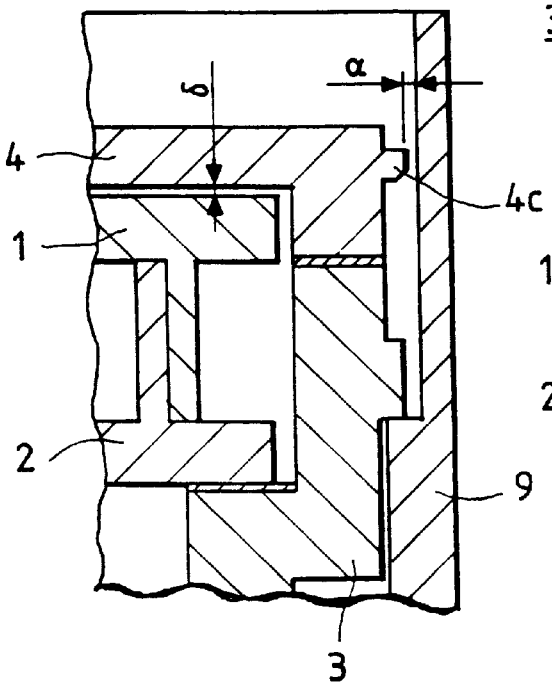
FIG. 2A is a longitudinal sectional view of the main part of a scroll compressor before welding according to a second embodiment of the invention and FIG. 2B is a longitudinal sectional view of the main part of the scroll compressor after welding according to the second embodiment of the invention.
Figure 2B:
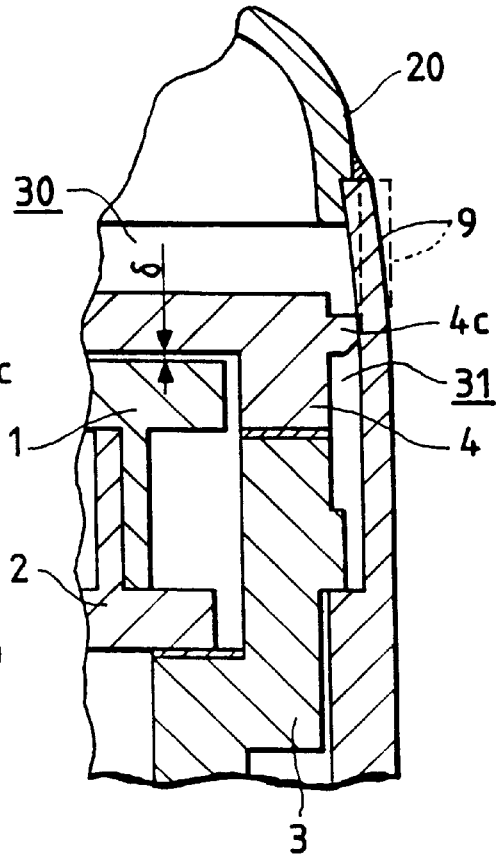

Embodiment 2:

FIGS. 2A and 2B show a second embodiment of the invention; FIG. 2A is a longitudinal sectional view of the main part of a scroll compressor before welding and FIG. 2B is a longitudinal sectional view of the main part of the scroll compressor after welding.

In FIGS. 2A and 2B, a radially outward peripheral projection 4*c* is formed over the entire outer peripheral surface of a separation plate 4 so that the projection 4*c* presents a flange-like configuration. The peripheral projection 4*c* is set to an outer periphery forming a predetermined minute gap α relative to the inner periphery of a shell main body 9. That is, the peripheral projection 4*c* is set to an outer diameter reduced, relative to the inner diameter of the shell main body 9 before a shell lid 20 is sealingly attached by welding, etc. by the dimension corresponding to the shrinkage amount of the shell main body 9.

The separation plate 4 is bolted to a frame 3 fixed to the shell main body 9 under a condition that a fixed scroll 1 and the separation plate 4 are held in parallel to each other. At this time, the minute gap α occurs between the inner peripheral surface of the shell main body 9 and the outer peripheral surface of the peripheral projections 4*c*. After assembly, the shell lid 20 is mounted so as to seal a top face opening of the shell main body 9 and joined by welding all around. The top end part of the shell main body 9 weaker in rigidity than the part fixing the frame 3, etc., is shrunk in a direction of reducing the diameter because of welding distortion due to the welding, thereby causing the outer peripheral surface of the peripheral projection 4*c* to come in tight contact with the inner peripheral surface of the shell main body 9.

Therefore, the space is partitioned and sealed between a high pressure space 30 and a low pressure space 31 because of the tight contact of the outer peripheral surface of the peripheral projection 4*c* and the inner peripheral surface of the shell main body 9.

Figure 3A:
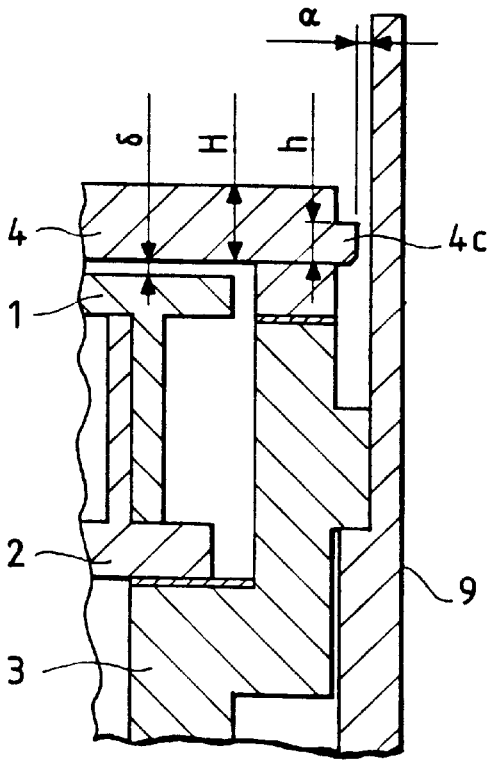
FIG. 3A is a longitudinal sectional view of the main part of a scroll compressor before welding according to a third embodiment of the invention and FIG. 3B is a longitudinal sectional view of the main part of the scroll compressor after welding according to the third embodiment of the invention.
Figure 3B:
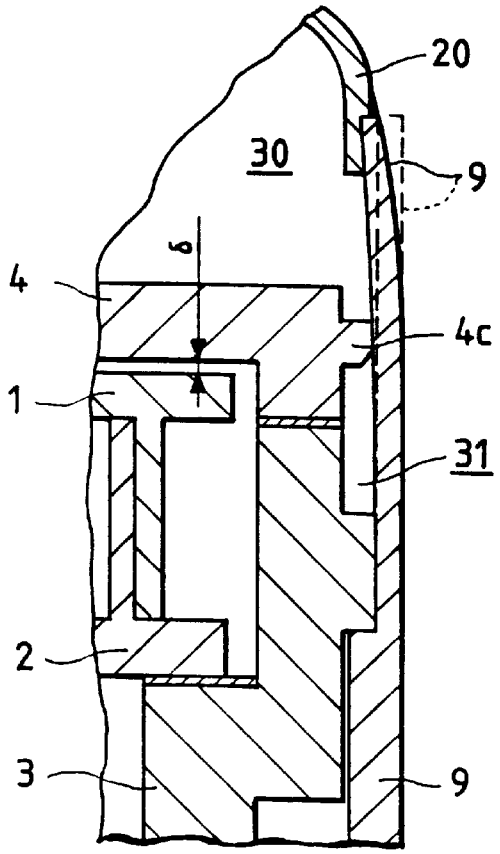

Embodiment 3:

FIGS. 3A and 3B show a third embodiment of the invention; FIG. 3A is a longitudinal sectional view of the main part of a scroll compressor before welding and FIG. 3B is a longitudinal sectional view of the main part of the scroll compressor after welding.

In FIGS. 3A and 3B, a peripheral projection 4*c* is formed over the entire outer peripheral surface of a separation plate 4. The peripheral projection 4*c* is set so as to become an outer face forming a predetermined minute gap a relative to the inner face of a shell main body 9, and the axial position of the peripheral projection 4*c* is set so that the height from the bottom end position to top end position of the peripheral projection 4*c*, h, becomes "h≈H/2" where H is the thickness of the separation plate 4. That is, the axial placement position of the peripheral projection 4*c* on the separation plate 4 is set to a position where the separation plate 4 pressed radially inward by the shell main body 9 shrunk after a shell lid 20 is sealed by welding, etc., does not axially bend.

The separation plate 4 is bolted to a frame 3 fixed to the shell main body 9 under a condition that a fixed scroll 1 and the separation plate 4 are held in parallel to each other. At this time, a predetermined moving gap δ (relief amount) is made between the separation plate 4 and the base plate of the fixed scroll 1, and the predetermined minute gap α is made between the inner peripheral surface of the shell main body 9 and the outer peripheral surface of the peripheral projection 4*c*, as described above. Then, after assembly, the shell lid 20 is mounted on a top face opening of the shell main body 9 and joined by welding all around. The top end part of the shell main body 9 weaker in rigidity than the part fixing the frame 3, etc., is shrunk in a direction of reducing the diameter because of welding distortion due to the welding, thereby causing the outer peripheral surface of the peripheral projection 4*c* to come in tight contact with the inner peripheral surface of the shell main body 9.

Figure 4:
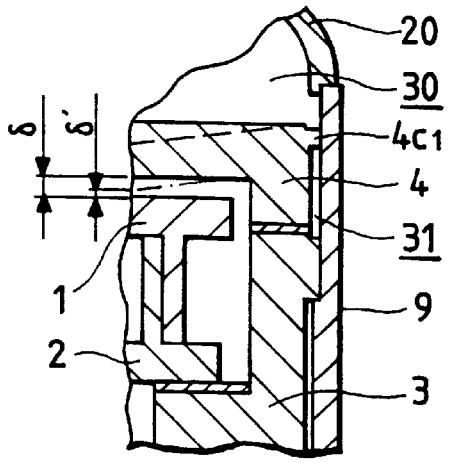
FIG. 4 is an illustration to explain an structure example in comparison with the scroll compressor according to the third embodiment of the invention.
Figure 5:
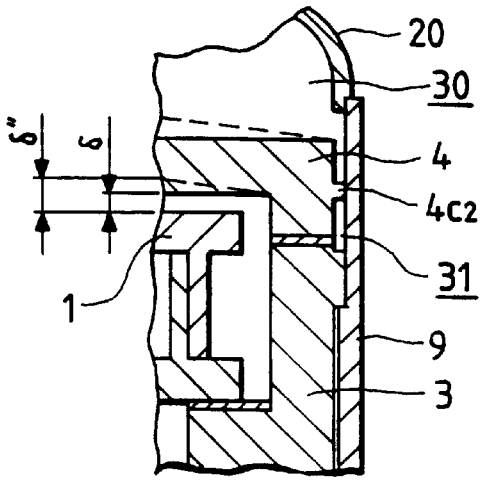
FIG. 5 is an illustration to explain another structure example in comparison with the scroll compressor according to the third embodiment of the invention.

FIG. 4 is an illustration to explain an structure example in comparison with the scroll compressor of the third embodiment. FIG. 5 is an illustration to explain another structure example in comparison with the scroll compressor of the third embodiment.

The figures represent each a deformation state of a separation plate 4 when the separation plate 4 is pressed so that the inner peripheral surface of a shell main body 9 comes in tight contact with peripheral projection 4*c*1, 4*c*2 because of shrinkage after the shell main body 9 and a shell lid 20 are welded. Also, a moving gap 5 is set between the separation plate 4 and a fixed scroll base plate 1*b*.

First, as shown in FIG. 4, if the peripheral projection 4*c*1 is positioned upper than the axial center of the separation plate 4, the top end part of the separation plate 4 is pressed by pressure of the shell main body 9. Thus, a moment acts and the separation plate 4 becomes deformed like a concave; moving gap δ' after the deformation becomes less than the former moving gap δ (δ'<δ). Therefore, the moving gap becomes uneven on the entire opposed face.

In contrast, as shown in FIG. 5, if the peripheral projection 4*c*2 is positioned lower than the axial center of the separation plate 4, the lower part of the separation plate 4 is pressed by pressure of the shell main body 9. Thus, the separation plate 4 becomes deformed like a convex; moving gap δ" after the deformation becomes larger than the setup moving gap δ (δ">δ).

Then, as with the scroll compressor shown in FIGS. 3A and 3B, the peripheral projection 4*c* is placed in the vicinity of the axial center of the separation plate 4, whereby the outer peripheral surface of the peripheral projection 4*c* comes in tight contact with the inner peripheral surface of the shell main body 9, sealing the space between the high pressure space 30 and the low pressure space 31, and even if the shell main body 9 presses the peripheral projection 4*c* because of shrinkage of the shell main body 9, the separation plate 4 does not axially become deformed. Thus, the moving gap δ (relief amount) does not become uneven on the entire opposed face; an even moving gap can be provided easily.

Figure 6:
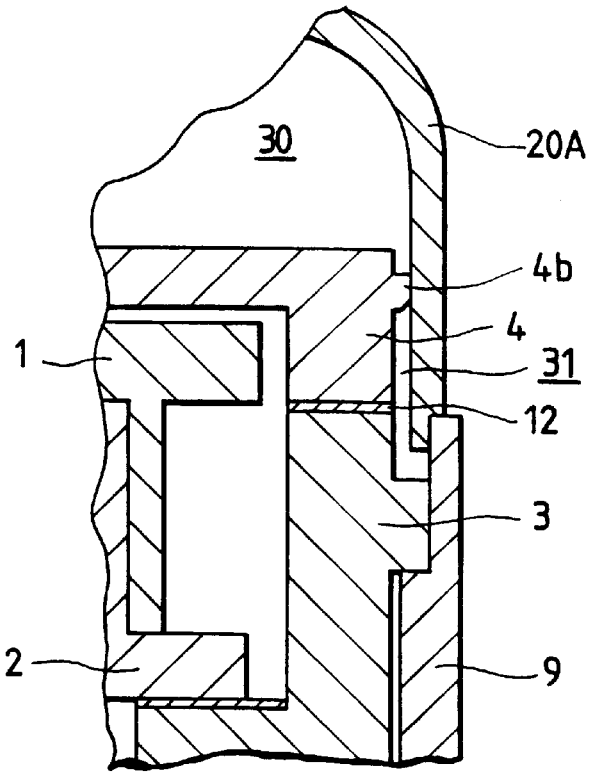
FIG. 6 is a longitudinal sectional view of the main part of a scroll compressor according to a fourth embodiment of the invention.

Embodiment 4:

FIG. 6 is a longitudinal sectional view of the main part of a scroll compressor according to a fourth embodiment of the invention.

In the figure, a radially outward peripheral projection 4*b* is formed over the entire outer peripheral surface of a separation plate 4. The peripheral projection 4*b* is set to an outer diameter having predetermined interference relative to the inner diameter of a shell lid 20A having a long longitudinal dimension. This predetermined interference is set to a dimension to such a degree that the outer peripheral surface of the peripheral projection 4*b* of the separation plate 4 is pressed into and comes in tight contact with the inner peripheral surface of the shell lid 20A.

The separation plate 4 is bolted to a frame 3 fixed to a shell main body 9 under a condition that a fixed scroll 1 and the separation plate 4 are held in parallel to each other. After this, the separation plate 4 is pressed into the shell lid 20A and further the bottom end part of the shell lid 20A and the top end of the shell main body 9 are joined by welding all around.

Therefore, the space is partitioned and sealed between a high pressure space 30 and a low pressure space 31 because of the tight contact of the outer peripheral surface of the peripheral projection 4*b* and the inner peripheral surface of the shell lid 20A.

Figure 7A:
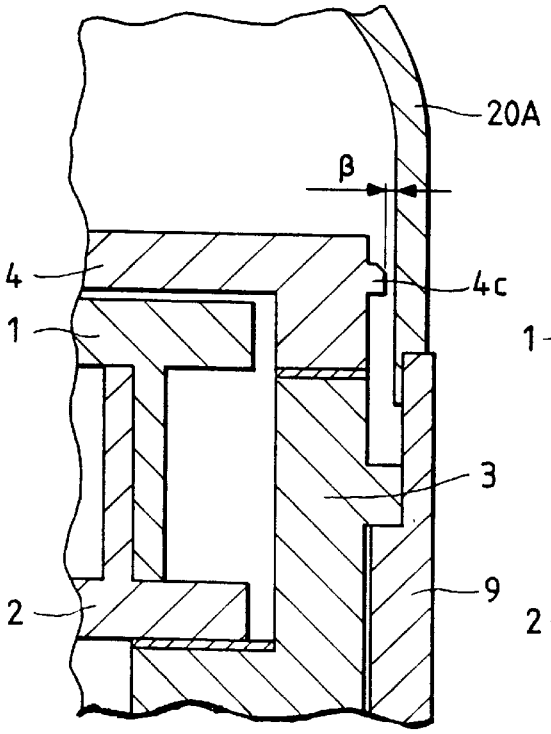
FIG. 7A is a longitudinal sectional view of the main part of a scroll compressor before welding according to a fifth embodiment of the invention and FIG. 7B is a longitudinal sectional view of the main part of the scroll compressor after welding according to the fifth embodiment of the invention.
Figure 7B:
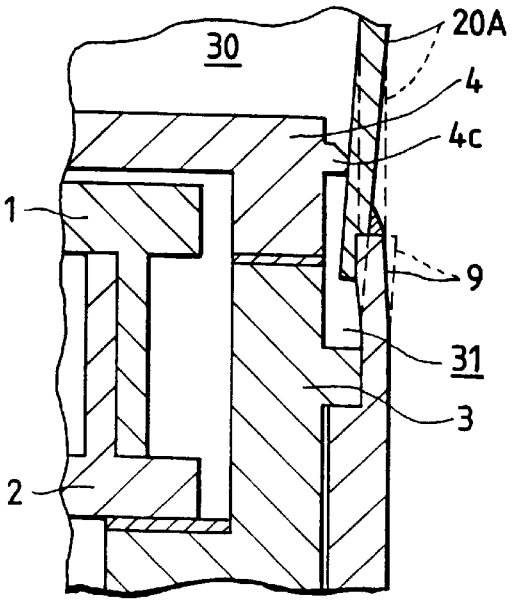

Embodiment 5:

FIGS. 7A and 7B show a fifth embodiment of the invention; FIG. 7A is a longitudinal sectional view of the main part of a scroll compressor before welding and FIG. 7B is a longitudinal sectional view of the main part of the scroll compressor after welding.

In FIGS. 7A and 7B, a radially outward peripheral projection 4*c* is formed over the entire outer peripheral surface of a separation plate 4. The peripheral projection 4*c* is set to an outer peripheral surface forming a predetermined minute gap β relative to the inner peripheral surface of a shell lid 20A. That is, the peripheral projection 4*c* is set to an outer diameter reduced, relative to the inner diameter of the shell lid 20A before the shell lid 20 is sealed on a shell main body 9 by welding, etc. by the dimension corresponding to the shrinkage amount of the shell lid 20A.

The separation plate 4 is bolted to a frame 3 fixed to the shell main body 9 under a condition that a fixed scroll 1 and the separation plate 4 are held in parallel to each other. After assembly, the shell lid 20A is inserted into the shell main body 9. At this time, the minute gap 1 is made between the inner peripheral surface of the shell lid 20A and the outer peripheral surface of the peripheral projection 4*c*. The shell lid 20A and the shell main body 9 are joined by welding all around. The shell lid 20A is shrunk because of welding distortion due to the welding, etc., causing the outer peripheral surface of the peripheral projections 4*c* to come in tight contact with the inner peripheral surface of the shell lid 20A.

Therefore, the space is partitioned and sealed between a high pressure space 30 and a low pressure space 31 because of the tight contact of the outer peripheral surface of the peripheral projection 4*c* of the separation plate 4 and the inner peripheral surface of the shell lid 20A.

Figure 8:
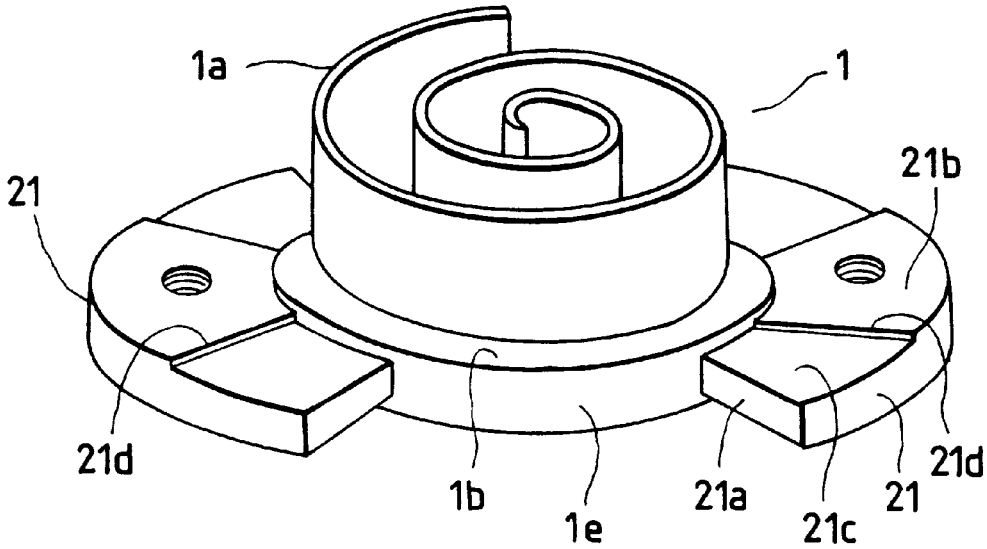
FIG. 8 is a perspective view to show a fixed scroll and flange parts of a scroll compressor according to a sixth embodiment of the invention.
Figure 9:
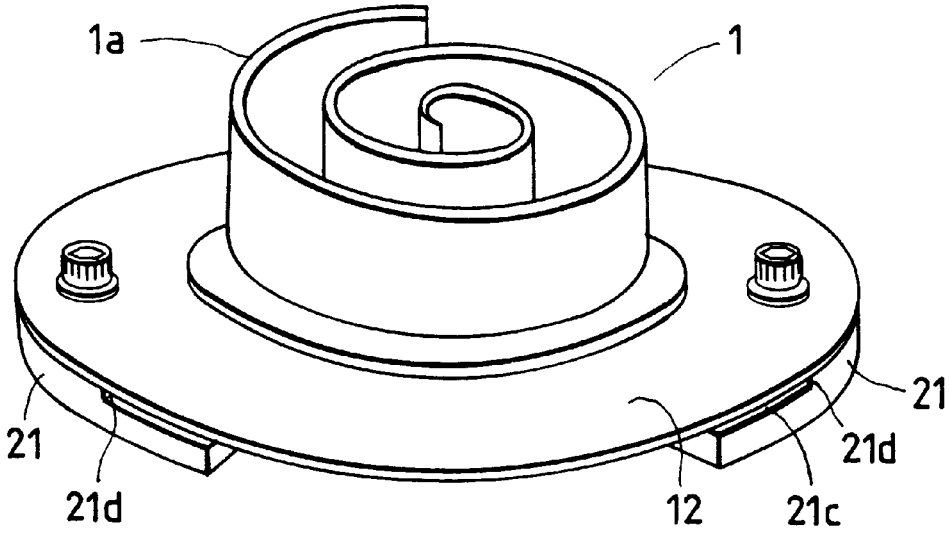
FIG. 9 is a perspective view to show the fixed scroll, the flange parts, and an elastic body of the scroll compressor according to the sixth embodiment of the invention.
Figure 10:
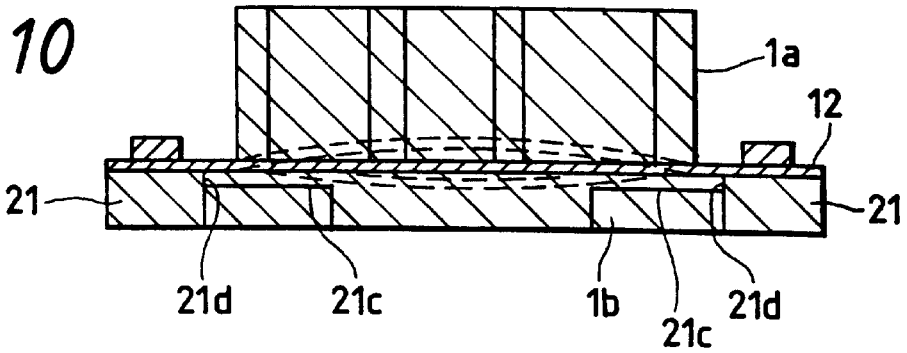
FIG. 10 is a state illustration to show how the elastic body displaces during the operation of the scroll compressor according to the sixth embodiment of the invention.

Embodiment 6:

FIG. 8 is a perspective view to show a fixed scroll and flange parts of a scroll compressor according to a sixth embodiment of the invention. FIG. 9 is a perspective view to show the fixed scroll, the flange parts, and an elastic body of the scroll compressor. FIG. 10 is a state illustration to show how the elastic body displaces during the operation of the scroll compressor.

In FIG. 8, numeral 1*b* is a fixed scroll base plate of a fixed scroll 1. The fixed scroll base plate 1*b* has an outer diameter set to the possible minimum diameter to allow a set suction volume (a forcing volume) to be provided (≈outer diameter of wind end part of plate-like spiral tooth 1*a*+orbiting radius of orbiting scroll×2). Numeral 21 is two radially outward flange parts projected discontinuously in the circumferential direction on the outer peripheral surface of the fixed scroll base plate 1*b*. Numeral 21*b* is an elastic body fixing part for fixedly supporting an elastic body 12 like a ring plate made of a spring plate, etc. Side faces le of the fixed scroll base plate 1*b* and side faces 21*a* of the flange parts 21 are in a casting skin condition without grinding, etc.

Numeral 21*c* is a step part made in the flange part 21 of the fixed scroll 1. It is set to a level difference lowered by a predetermined dimension toward the axially anti-spiral side relative to the elastic body fixing part 21*b* of the flange part 21. The step part 21*c* is formed so that the portion of the flange part 21 other than the elastic body fixing part 21*b* is cut axially and does not interfere with the elastic body 12.

In FIG. 9, the elastic body 12 is fitted to the fixed scroll 1 with bolts, etc. Further, in this state, it is fitted to a frame 3 for operation. The fixed scroll 1 during the operation moves axially depending on the operation condition.

At this time, as shown in FIG. 10, a part of the elastic body 12 is supported on the fixed scroll 1, thus relatively the elastic body 12 oscillates axially with an end 21*d* of the flange part 21 as an oscillation supporting point on the fixed scroll 1 side thereof.

Therefore, each of the flange parts 21 is formed with the step part 21*c* set to a predetermined cut (relief) amount more than the deflection amount of the elastic body 12, whereby if the elastic body 12 deflects, the oscillation support point at the time is fixed to the end 21*d*, thus the oscillation support point remains unchanged.

Figure 11A:
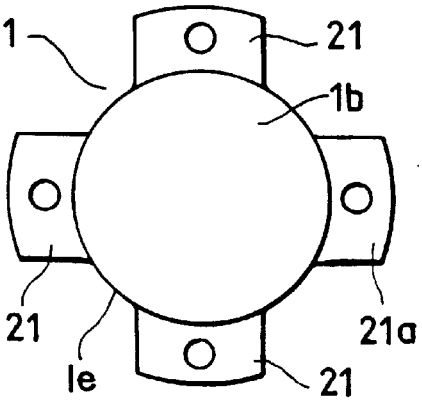
FIG. 11A is a plan view to show a fixed scroll of a scroll compressor according to a seventh embodiment of the invention.
Figure 11B:
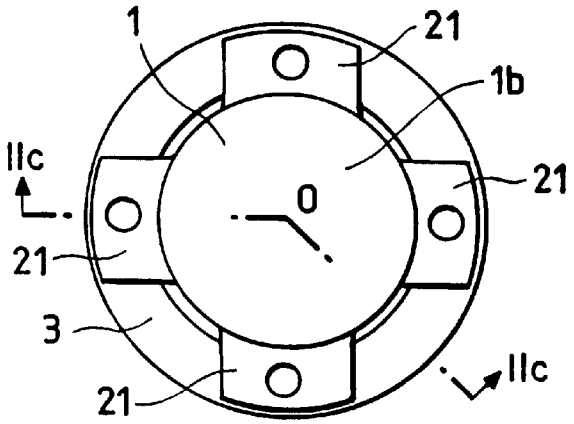
FIG. 11B is a plan view to show a form in which the fixed scroll of the scroll compressor is fitted to a frame with flange parts according to the seventh embodiment of the invention.
Figure 11C:
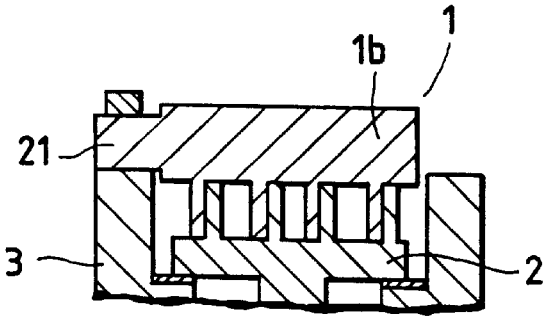
FIG. 11C is a sectional view taken on line 11*c*—11*c* in FIG. 11B.

Embodiment 7:

FIGS. 11A, 11B and 11C show a seventh embodiment of the invention; FIG. 11A is a plan view to show a fixed scroll of a scroll compressor, FIG. 11B is a plan view to show a form in which the fixed scroll of the scroll compressor is fitted to a frame with flange parts, and FIG. 11C is a sectional view taken on line A-O-A in FIG. 11B.

In FIGS. 11A to 11C, numeral 1*b* is a fixed scroll base plate of a fixed scroll 1. The fixed scroll base plate 1*b* has an outer diameter set to the possible minimum diameter to allow a set suction volume (a forcing volume) to be provided (≈outer diameter of wind end part of plate-like spiral tooth+orbiting radius of orbiting scroll×2). Numeral 21 is four flange parts disposed on the peripheral wall of the fixed scroll base plate 1*b*. The bottom faces of the flange parts 21 (faces on the side of the plate-like spiral tooth) are directly brought into tight contact with the top end face of a frame 3 and fixedly supported thereby. Side faces 1*e* of the fixed scroll base plate 1*b* and side faces 21*a* of the flange parts 21 are in a casting skin condition without grinding, etc.

Since the fixed scroll 1 is directly brought into tight contact with and fixedly supported by the frame 3, axial dimension management can be simplified for each part.

Figure 12:
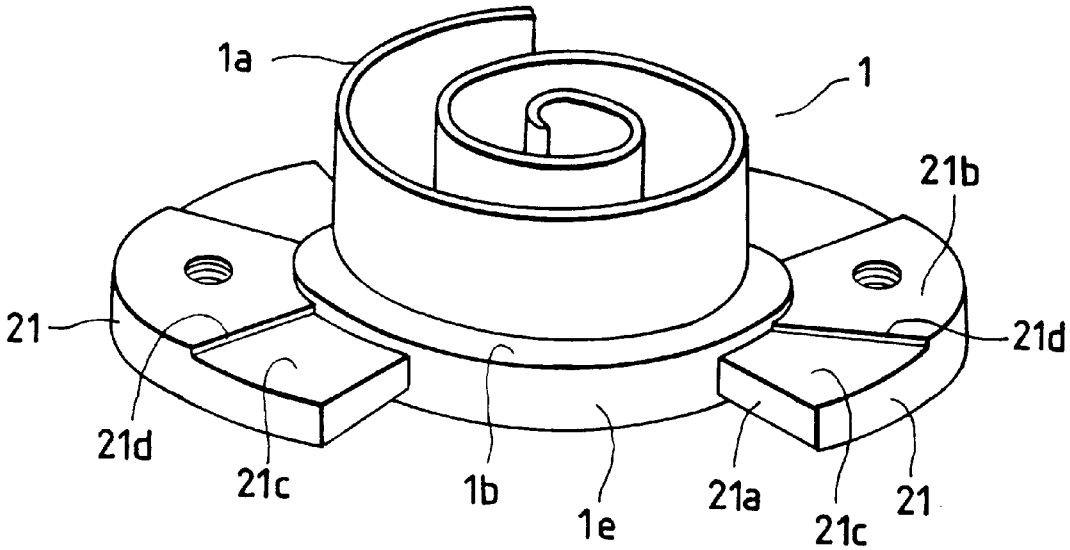
FIG. 12 is a perspective view to show a fixed scroll and flange parts of a scroll compressor according to an eighth embodiment of the invention.
Figure 13:
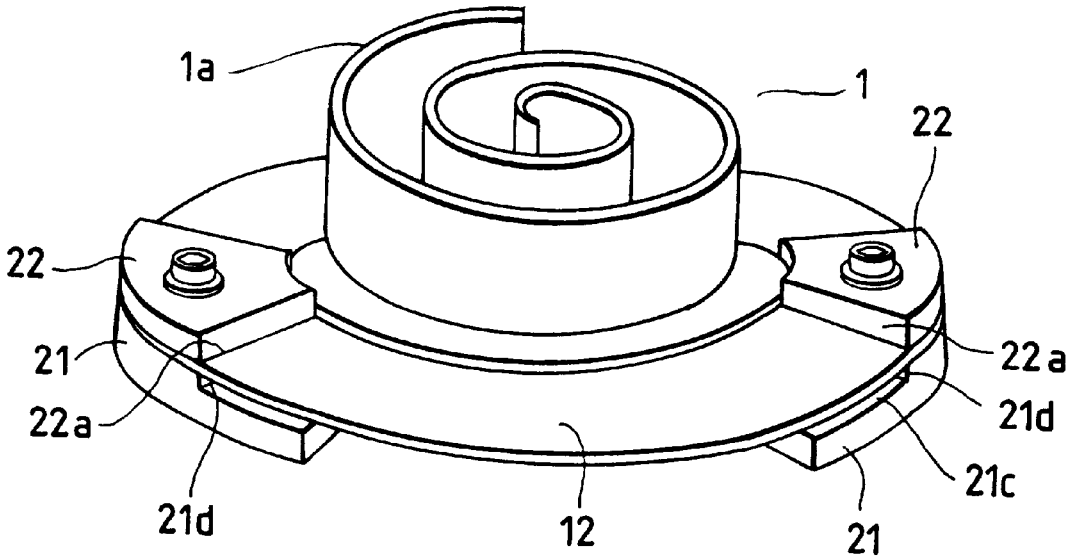
FIG. 13 is a perspective view to show the fixed scroll, the flange parts, an elastic body, and spacers of the scroll compressor according to the eighth embodiment of the invention.
Figure 14:
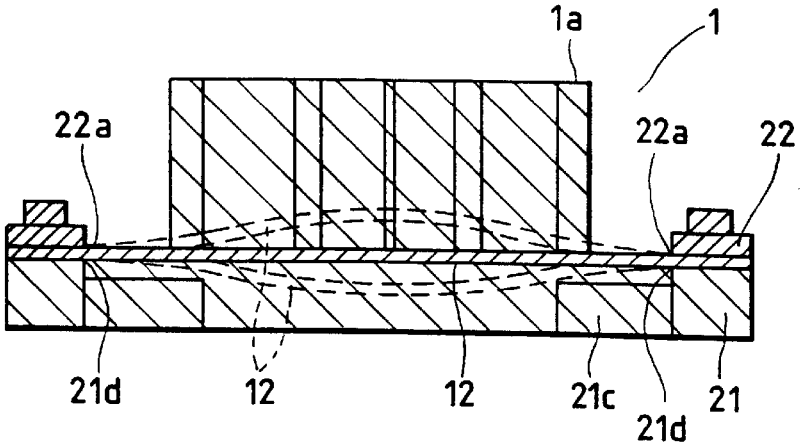
FIG. 14 is a state illustration to show how the elastic body displaces during the operation of the scroll compressor according to the eighth embodiment of the invention.
Figure 15:
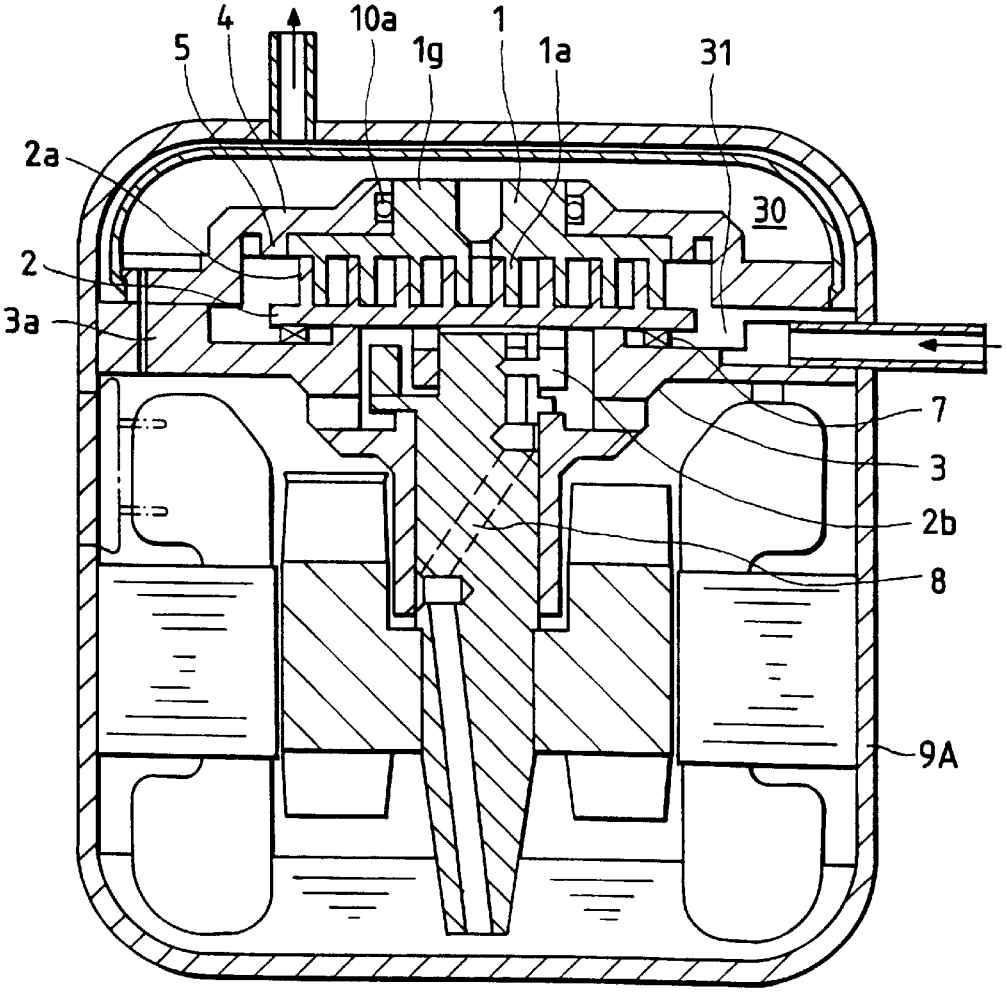
FIG. 15 RELATED ART
FIG. 15 is a longitudinal sectional view of a scroll compressor of conventional example 1.
Figure 16:
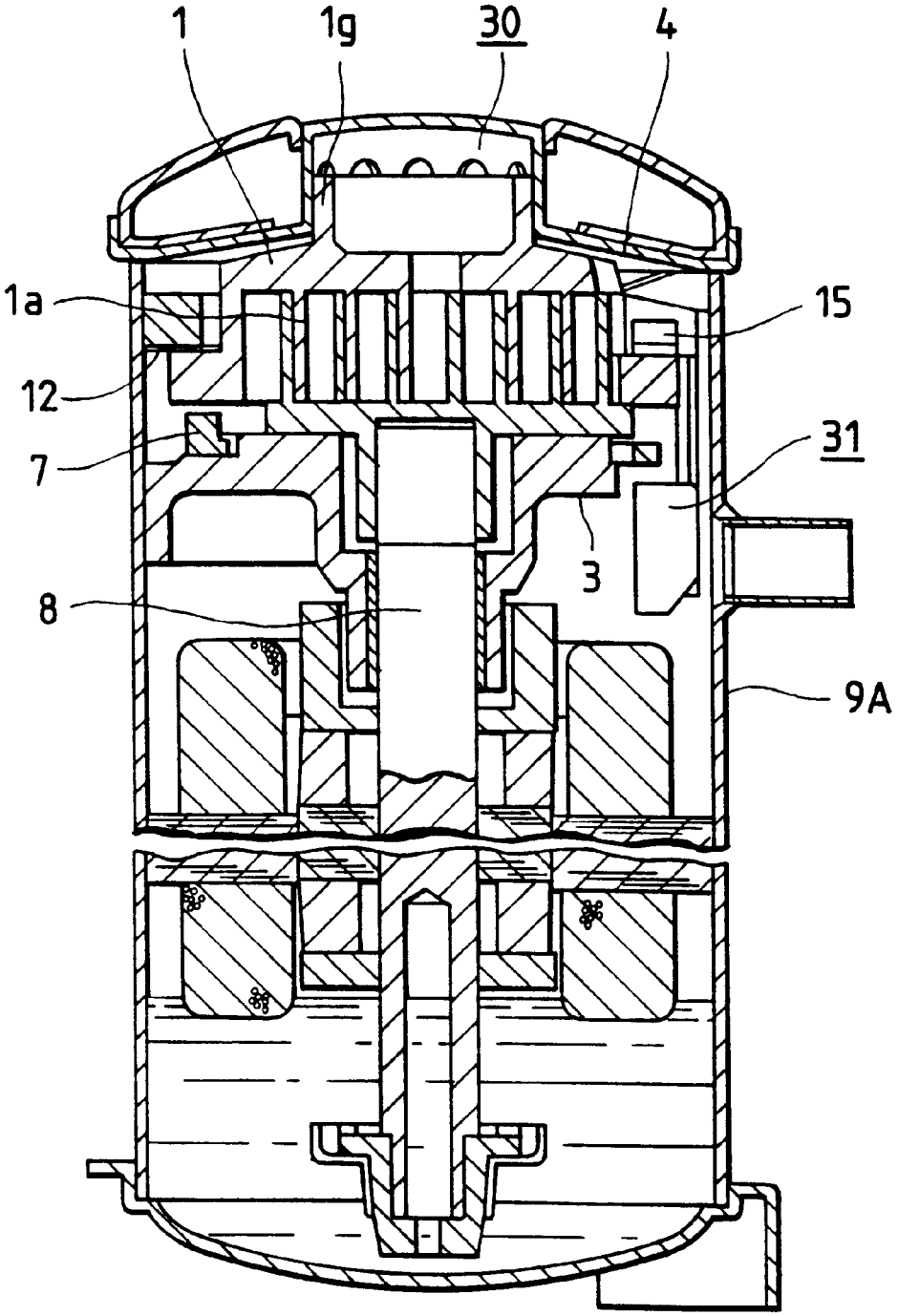
FIG. 16 is a longitudinal sectional view of a scroll compressor of conventional example 2.
Figure 17:
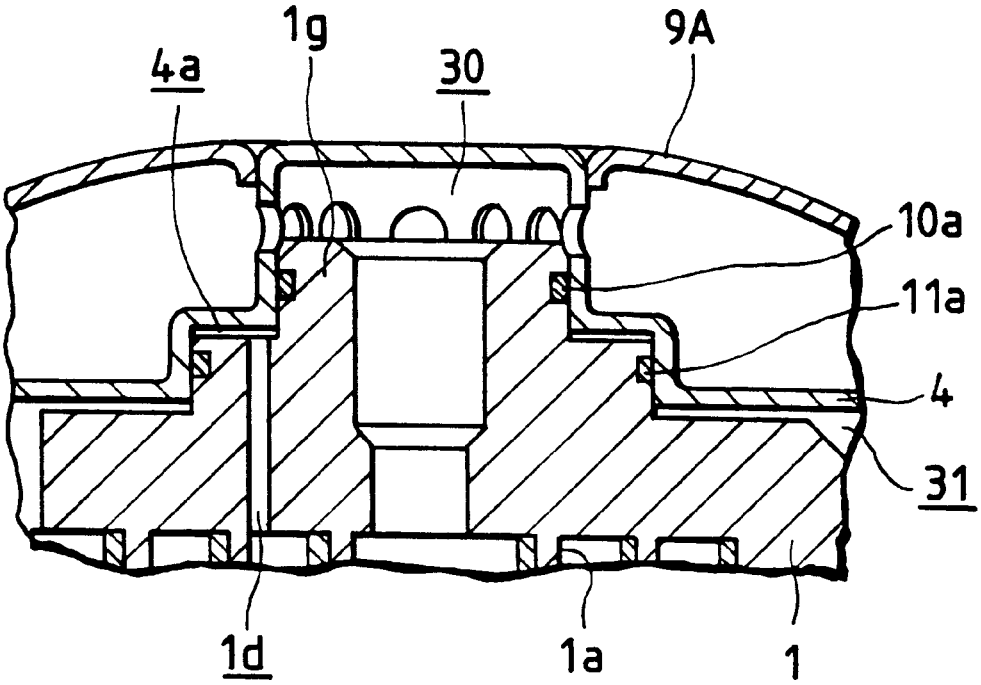
FIG. 17 is an enlarged longitudinal sectional view to show the main part of the scroll compressor of conventional example 2.

Embodiment 8:

FIG. 12 is a perspective view to show a fixed scroll and flange parts of a scroll compressor according to an eighth embodiment of the invention. FIG. 13 is a perspective view to show the fixed scroll, the flange parts, an elastic body, and spacers of the scroll compressor. FIG. 14 is a state illustration to show how the elastic body displaces during the operation of the scroll compressor.

In FIG. 12, numeral 1*b* is a fixed scroll base plate of a fixed scroll 1. The fixed scroll base plate 1*b* has an outer diameter set to the possible minimum diameter to allow a set suction volume (forcing volume) to be provided (≈outer diameter of wind end part of plate-like spiral tooth 1*a*+orbiting radius of orbiting scroll×2). Numeral 21 is two flange parts projected on the outer peripheral surface of the fixed scroll base plate 1*b*. Numeral 21*b* is an elastic body fixing part for fixing an elastic body 12, etc. Side faces le of the fixed scroll base plate 1*b* and side faces 21*a* of the flange parts 21 are in a casting skin condition without grinding, etc. Numeral 21*c* is a step part made in the flange part 21. It is set to a level difference lowered by a predetermined dimension toward the axially anti-spiral side relative to the elastic body fixing part 21*b* of the flange part 21. Numeral 22 is spacers each formed like substantially the same plane form as the elastic body fixing part 21*b* and placed below the elastic body fixing part 21*b*; the elastic body 12 is sandwiched between the spacers 22 and the elastic body fixing parts 21*b*.

In FIG. 13, the elastic body 12 is fitted to the fixed scroll 1 via the spacers 22. Ends 22*a* of the spacers 22 are set to the same positions as ends 21*d* of step parts 21*c* in the fixed scroll 1. In this state, the elastic body 12 is fitted to the frame 3 for operation.

Then, as shown in FIG. 14, the fixed scroll 1 during the operation moves axially depending on the operation condition. A part of the elastic body 12 is supported on the frame 3, thus relatively the elastic body 12 oscillates axially with the end 21*d* as an oscillation supporting point on the fixed scroll 1 side and with the end 22*a* of the spacer 22 as an oscillation supporting point on the opposite side.

That is, each of the flange parts 21 is formed with the step part 21*c* set to a predetermined cut (relief) amount more than the deflection amount of the elastic body 12, the spacers 22 are fitted to the opposite sides via the elastic body 12 to the flange parts 21*b*, and the ends 22*a* of the spacers 22 are placed in the same positions as the ends 21*d* of the step parts 21*c* for fixing the flange parts 21, the elastic body 12, and the spacers 22 of the fixed scroll 1 integrally, whereby if the elastic body 12 deflects during the operation, the oscillation support point is fixed to the ends 21*d* and 22*a*, thus remains unchanged regardless of which axial direction the oscillation direction is. Therefore, stress of the elastic body 12 can be reduced and fatigue failure can be prevented.

Thus, according to the invention, the fixed scroll and the separation plate are assembled with them held in parallel. In this state, upon the separation plate is pressed into the shell main body supporting and fixing the frame thereon and comes in tight contact with the inner peripheral surface of the shell main body, the frame and the separation plate are fixed, then the shell main body and the shell lid are welded. Thus, deformation of the shell main body caused by the welding does not change the parallel relationship between the separation plate and the fixed scroll, and the separation plate and the shell main body produce a seal between high pressure and low pressure, providing a high-performance and high-reliability compressor.

According to the invention, the separation plate having a peripheral projection of an outer diameter reduced by a predetermined dimension relative to the inner diameter of the shell main body is assembled to the fixed scroll under a condition that they are held in parallel to each other. In this state, the separation plate is pressed into the shell main body fixedly supporting the frame thereon, and the separation plate and the frame are fixed, and then the shell lid and the shell main body are welded, whereby shrinkage of the shell main body is used to cause the outer peripheral surface of the peripheral projection of the separation plate to come in tight contact with the inner peripheral surface of the shell main body to provide sealing between high pressure and low pressure. Thus, although the shell main body becomes deformed by the welding, the parallel relationship between the separation plate and the fixed scroll does not change, and the peripheral projection of the separation plate and the shell main body produce a seal between high pressure and low pressure. Therefore, a high-performance and high-reliability compressor is provided.

According to the invention, the separation plate having a peripheral projection of an outer diameter reduced by a predetermined dimension relative to the inner diameter of the shell main body is assembled to the fixed scroll under a condition that they are held in parallel to each other. In this state, the separation plate is pressed into the shell main body fixedly supporting the frame thereon, and the separation plate and the frame are fixed, and then the shell lid and the shell main body are welded, whereby shrinkage of the shell main body is used to cause the outer peripheral surface of the peripheral projection of the separation plate to come in tight contact with the inner peripheral surface of the shell main body to provide sealing between high pressure and low pressure, and the peripheral projection of the separation plate is placed at a predetermined axial position of the separation plate. Thus, although the shell main body presses the peripheral projection of the separation plate because of shrinkage of the shell main body after the shell lid is sealed, the separation plate does not axially become deformed, so that the moving gap between the separation plate and the fixed scroll does not change over the full face; a predetermined moving gap is provided. Therefore, a high-performance and high-reliability compressor is provided.

Thus, according to the invention, the separation plate and the fixed scroll are assembled under a condition that they are held in parallel to each other. In this state, the separation plate is inserted into the shell main body fixedly supporting the frame, the separation plate and the frame are fixed, the shell lid is coupled to the shell main body so that the separation plate is in tight contact with the inner periphery of the shell lid, and then the shell main body and the shell lid are welded. Thus, deformation of the shell lid caused by the welding does not change the parallel relationship between the separation plate and the fixed scroll, and the separation plate and the shell lid produce a seal between high pressure and low pressure, providing a high-performance and high-reliability compressor.

According to the invention, the separation plate having a peripheral projection of an outer diameter reduced by a predetermined dimension relative to the inner diameter of the shell lid is assembled to the fixed scroll under a condition that they are held in parallel to each other. In this state, the separation plate is inserted into the shell main body fixedly supporting the frame, and the separation plate and the frame are fixed, and then the shell lid and the shell main body are welded. The shrinkage of the shell lid at this time is used to cause the outer peripheral surface of the peripheral projection of the separation plate to come in tight contact with the inner peripheral surface of the shell lid for sealing between high pressure and low pressure. Thus, although the shell lid becomes deformed by the welding, the parallel relationship between the separation plate and the fixed scroll does not change, and the peripheral projections of the separation plate and the shell lid produce a seal between high pressure and low pressure, providing a high-performance and high-reliability compressor.

According to the invention, the supporting point of axial displacement of the elastic body fitted to the fixed scroll can be fixed, thus fatigue failure caused by stress reduction of the elastic body can be prevented, providing a high-reliability compressor.

According to the invention, the fixed scroll is assembled to be brought into tight and direct contact with the frame, thus management of the axial dimension of the separation plate becomes unnecessary and management of tooth tip gap is facilitated; if there is no axial compliance mechanism, the fixed scroll can be made common.

According to the invention, the supporting point of axial displacement of the elastic body fitted to the fixed scroll can be fixed with respect to any oscillation directions, thus fatigue failure caused by stress reduction of the elastic body can be prevented, providing a higher-reliability compressor.

What is claimed is:

1. A scroll compressor comprising:

a sealed vessel including a shell main body and a shell lid sealingly attached to said shell main body to close a top face of said shell main body;

a fixed scroll arranged within said sealed vessel so that motion of said fixed scroll in radial and rotation directions is restrained, said fixed scroll having a plate-like spiral tooth;

an orbiting scroll having a plate-like spiral tooth and forming a compression space by combining said plate-like spiral teeth of said fixed scroll and orbiting scroll;

a frame fixed to an inner peripheral surface of said shell main body and slidably supporting said orbiting scroll; and a separation plate arranged in tight contact with an inner peripheral surface of said sealed vessel without welding between said separation plate and said inner peripheral surface of said sealed vessel, and out of contact with end faces of both of said shell main body and said shell lid, so that a space in said sealed vessel is divided into a high pressure space and a low pressure space, wherein said frame is located within said low pressure space.

2. A scroll compressor according to claim 1, wherein said separation plate is fixed to said frame through a bolt.

3. A scroll compressor according to claim 1, wherein said separation plate is set to an outer diameter providing a predetermined interference to such a degree that an outer peripheral surface of said separation plate can be pressure-inserted into said shell main body to come in tight contact with said inner peripheral surface of said shell main body.

4. A scroll compressor according to claim 1, further comprising:

at least two flange parts projected radially outwardly from an outer periphery of said fixed scroll and discontinuous to each other in a circumferential direction of said fixed scroll, each of said flange parts having a bottom face directly supported on a top end face of said frame.

5. A scroll compressor according to claim 1, wherein said fixed scroll is disposed below said separation plate via a moving gap permitting said fixed scroll to make a minute motion in an axial direction.

6. A scroll compressor according to claim 1, wherein said separation plate has a peripheral projection projected radially outwardly from and continuously elongated over an entire outer peripheral surface of said separation plate.

7. A scroll compressor according to claim 1, wherein said separation plate is set to an outer diameter providing a predetermined interference to such a degree that an outer peripheral surface of said separation plate can be pressure-inserted into said shell lid to come in tight contact with an inner peripheral surface of said shell lid.

8. A scroll compressor according to claim 1, wherein said separation plate has a peripheral projection projected radially outwardly from and continuously elongated over an entire outer peripheral surface of said separation plate, said peripheral projection is set to an outer diameter reduced, relative to an inner diameter of said shell lid before said shell lid is sealingly attached to said shell main body, by a dimension corresponding to a shrinkage amount of said shell lid, and an outer peripheral surface of said peripheral projection is brought in line-contact with an inner peripheral surface of said shell lid entirely upon said shell lid is sealingly attached to said shell main body.

9. A scroll compressor according to claim 1, wherein said separation plate has a peripheral projection projected radially outwardly from and continuously elongated over an entire outer peripheral surface of said separation plate, said peripheral projection is set to an outer diameter reduced, relative to an inner diameter of said shell main body before said shell lid is sealingly attached to said shell main body, by a dimension corresponding to a shrinkage amount of said shell main body, and an outer peripheral surface of said peripheral projection is brought in line-contact with said inner peripheral surface of said shell main body entirely upon said shell lid is sealingly attached to said shell main body.

10. A scroll compressor according to claim 4, wherein an axial placement position of said peripheral projection on said separation plate is set to a position where said separation plate pressed radially inward by said shell main body shrunk upon said shell lid is sealingly attached to said shell main body, does not axially bend.

11. A scroll compressor according to claim 5, wherein:

said fixed scroll has at least two flange parts projected radially outwardly from an outer periphery of said fixed scroll and discontinuous to each other in a circumferential direction of said fixed scroll;

an elastic body is supported on a top end face of said frame for elastically biasing said fixed scroll toward said separation plate;

each of said flange parts is formed on a bottom face with an elastic body fixing part for fixing said elastic body; and a portion of each of said flange part adjacent said elastic body fixing part is cut axially to form a step part which does not interfere with said elastic body.

12. A scroll compressor according to claim 11, wherein a spacer substantially identical in a plane form to corresponding one of said elastic body fixing parts is disposed below said corresponding elastic body fixing part so that said elastic body is sandwiched between said spacer and said corresponding elastic body fixing part.

* * * * *